US005901728A

United States Patent [19]

Hara et al.

[11] Patent Number: 5,901,728

[45] Date of Patent: May 11, 1999

[54] ALUMINUM ALLOY VALVE SPRING RETAINER AND METHOD OF MAKING SAME

[75] Inventors: Nobuo Hara; Makoto Abe, both of Fujisawa, Japan

[73] Assignee: Fuji Oozx, Inc., Japan

[21] Appl. No.: 08/815,717

[22] Filed: Mar. 12, 1997

[51] Int. Cl.[6] ..... F01L 3/02

[52] U.S. Cl. ..... 137/1; 251/337; 251/368; 123/188.3

[58] Field of Search ..... 251/337, 368; 123/188.3; 137/1

[56] References Cited

U.S. PATENT DOCUMENTS 3,273,856 9/1966 Tauschek ..... 251/337
3,416,771 12/1968 Updike ..... 251/337
3,466,009 9/1969 Giles ..... 251/337
5,370,092 12/1994 Shimizu et al. ..... 123/188.3

*Primary Examiner*—A. Michael Chambers
*Attorney, Agent, or Firm*—Zarley,McKee,Thomte,Voorhees & Sease

[57] ABSTRACT

The lower surface of a valve spring retainer is engaged on a valve spring in a valve operating mechanism of an internal combustion engine. The valve spring retainer is subjected to T6 treatment under JIS (Japanese Industrial Standard), and machined as finishing. The lower surface of the valve spring retainer is not machined, and remains as subjected to T6 treatment, thereby improving fatigue strength and wear resistance.

6 Claims, 1 Drawing Sheet

ALUMINUM ALLOY VALVE SPRING RETAINER AND METHOD OF MAKING SAME

BACKGROUND OF THE INVENTION

The present invention relates to an Al alloy valve spring retainer which is used in a valve operating mechanism of an internal combustion engine.

FIG. 2 illustrates one example of a valve operating mechanism of an internal combustion engine, in which to the upper end of a poppet valve 1 a valve spring retainer 3 is attached via a pair of semi-cylindrical cotters 2. Between a cylinder head (not shown) and the lower surface of a spring contacting flange 3*a* of the valve spring retainer 3, a valve spring 4 is provided, and the poppet valve 1 is usually energized upwards via the valve spring retainer 3. The numeral 5 denotes a rocker arm which contacts the upper end of the poppet valve 1 and which is shaken vertically by a rotary cam (not shown), thereby driving the valve in a vertical direction.

The valve spring retainer 3 used in such a valve operating mechanism is made of Al alloy to decrease inertia mass of the valve operating mechanism instead of steel which is usually used.

The Al alloy valve spring retainer is usually made by cold forging such as T6 treatment under JIS (Japanese Industrial Standard) and machining. T6 treatment under JIS means the steps of heating at about 500° C. for several hours, cooling rapidly by water quenching and heating for several hours between 100 and 200° C.

The valve spring retainer 3 is subjected to large repeating loads by the valve spring 4. Therefore, the flange 3*a* which is engaged with the valve spring 4 requires high fatigue strength and wear resistance. Such Al alloy spring retainer is softer than steel one, and mechanical strength is improved by T6 treatment to increase fatigue strength and wear resistance. However, machining such as lathes is made as finish on the whole inner and outer circumferential surface, so that fatigue strength and wear resistance are decreased.

This is because machining made after T6 treatment increases surface roughness and involving notch effect is likely to cause stress concentration to decrease fatigue strength. It is found that decrease in wear resistance is because a hardened surface layer formed by T6 treatment such as oxidizing coating layer is cut off and lost by machining.

SUMMARY OF THE INVENTION

In view of the disadvantages, it is an object of the present invention to provide an Al alloy valve spring retainer which improves fatigue strength and wear resistance of a portion which contacts a valve spring.

To achieve the object, according to the present invention, there is provided an Al alloy valve spring retainer subjected to T6 treatment under JIS and machining, and having a surface which contacts a valve spring, at least the surface not being machined, and remaining as subjected to T6 treatment.

The surface which is engaged with the valve spring and subjected to repeating loads remains as T6 treated surface without machining, thereby preventing the portion from forming stress concentration portion, and improving fatigue strength and wear resistance owing to hard oxidized coating layer.

BRIEF DESCRIPTION OF THE DRAWINGS

The features of the present invention will become more apparent from the following description with respect to an embodiment shown in the accompanying drawings wherein.

DETAILED DESCRIPTION OF THE PREFERRED EMBODIMENTS

Figure 1:
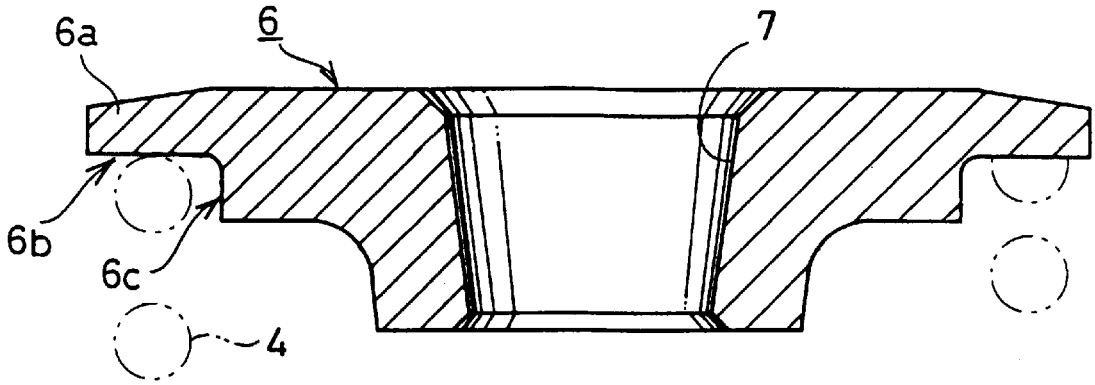
FIG. 1 is a central vertical sectional front view of one embodiment according to the present invention.
Figure 2:
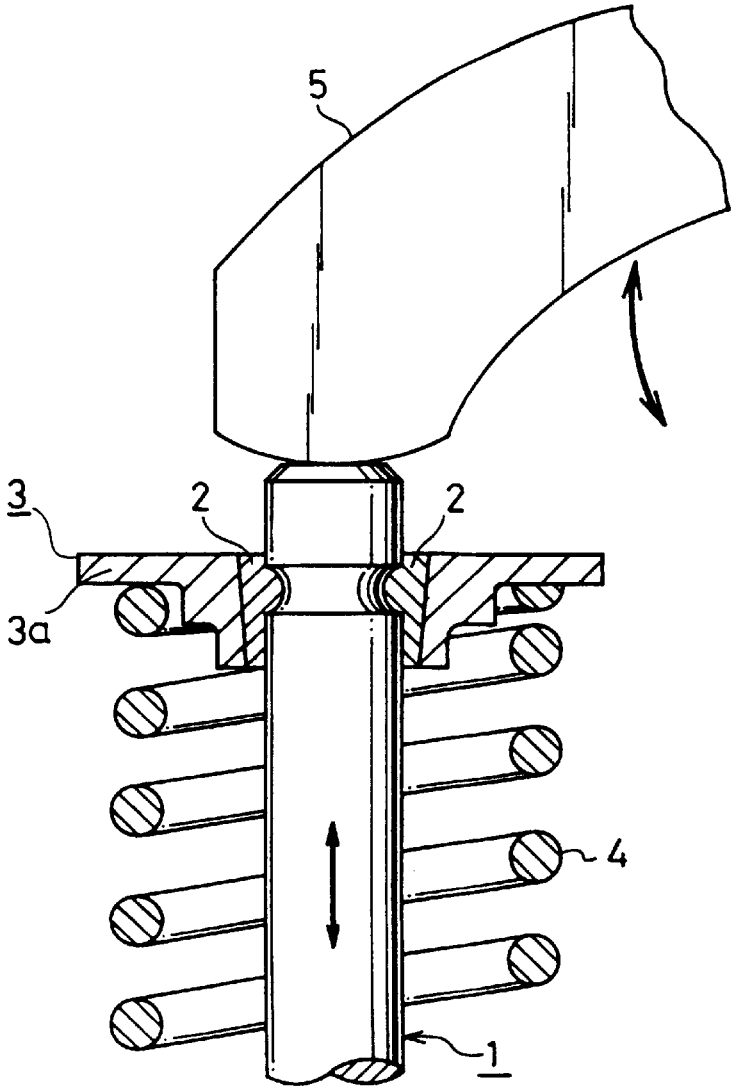
FIG. 2 is a central vertical sectional front view which shows one example of a valve operating mechanism of an internal combustion engine to which the present invention is applied.

FIG. 1 illustrates a valve spring retainer 6 according to the present invention in which material made of Al alloy such as Al—Si and Al—Cu is made by cold forging and strengthened by T6 treatment under JIS. The whole surface which contains the inner surface of an engagement bore 7 is made by machining as finish such as lathes except a lower surface 6*b* of a spring contacting flange 6*a* which is engaged with a valve spring 4, and except a continuous outer circumferential surface 6*c* of the T6 treated valve spring retainer 6. That is to say, the lower surface 6*b* and the outer circumferential surface 6*c* are not machined, but left subjected to T6 treatment without finishing. By such structure, fatigue strength and wear resistance of the spring contacting flange 6*a* which contacts the valve spring 4 increase. Increase in fatigue strength is because T6 treatment makes the surface flat to improve surface roughness so that ten point average roughness "Rz" in JIS may become less than 10 $\mu$m to lessen notch effect, so that stress concentration portion is not generated. Increase in wear resistance is because hard oxidizing coating layer formed by T6 treatment is not cut off, but remains since the lower surface 6*b* of the flange as subjected to T6 treatment is not machined.

In a valve spring retainer used in a relatively large internal combustion engine having a large spring constant of a valve spring, it requires higher fatigue strength, and therefore non-processed surface as made by T6 treatment may be all of the lower surface of the valve spring retainer.

The foregoings merely relate to an embodiment of the invention. Various changes and modifications may be made by person skilled in the art without departing from the scope of claims wherein:

What is claimed is:

1. A method of making an aluminum allow spring retainer comprising the steps of:

heating the retainer at about 500° C. for several hours;

cooling the retainer rapidly by water quenching and heating for several hours between 100° and 200° C.;

thereafter said valve spring retainer having a hardened outer surface layer including a surface which contacts a valve spring;

then removing portions of said hardened outer surface layer of said retainer without removing said surface which contacts said valve spring.

2. An aluminum alloy valve spring retainer subjected to treatment comprising the steps of heating at about 500° C. for several hours, cooling rapidly by water quenching and heating for several hours between 100° C. and 200° C. so as to form an oxidizing coating layer on said retainer; and retainer being subsequently cut with a cutting tool except along at least a surface which is adapted to contact a valve spring, said surface retaining said oxidizing coating layer and thereby having improved fatigue strength and wear resistance with respect to portions of the retainer which have been cut after treatment.

3. An aluminum alloy valve spring retainer comprising:

a body having an oxidizing coating layer formed thereon by the steps of heating said body at about 500° C. for several hours, cooling said body rapidly by water quenching, and heating said body for several hours between 100° C. and 200° C.;

said body having a surface thereon adapted to contact a valve spring, said surface being a part of said oxidizing coating layer;

said body being subsequently cut by a cutting tool so as to remove the oxidizing coating layer from the body except on said surface adapted to contact the valve spring;

the retention of said oxidizing coating layer on said surface thereby improving fatigue strength and wear resistance of said surface.

4. An aluminum alloy valve spring retainer comprising:

a body having upper and lower surfaces thereon, said lower surface being adapted to engage a valve spring;

said body being heat-and-quench hardened so as to form a hardened oxide layer over at least a first portion of said body including said lower surface;

a second portion of said body having tool marks made thereon from being cut by a cutting tool subsequent to being hardened;

said second portion overlapping said first portion without including said lower surface such that said lower surface is uninterrupted by any tool marks made subsequent to said lower surface being hardened.

5. The retainer of claim 4 wherein said first portion of said body is hardened according to a hardening process designated as T6 in Japanese Industrial Standards.

6. The retainer of claim 4 wherein said hardened oxide layer has a surface roughness of less than 10 $\mu$m $R_z$ on said lower surface.

* * * * *